United States Patent [19]

Coll

[11] Patent Number: 4,926,511

[45] Date of Patent: May 22, 1990

[54] MOVABLE SHOWER ASSEMBLY HAVING AN AUTOMATICALLY RETRACTING HOSE AND A SHOWER HEAD CAPABLE OF TAKING UP MULTIPLE POSITIONS

[76] Inventor: Alain Coll, 10 rue des Albatros, 77200 Croissy Beaubourg, France

[21] Appl. No.: 262,044

[22] Filed: Oct. 24, 1988

Related U.S. Application Data

[62] Division of Ser. No. 54,563, May 27, 1987, abandoned.

[30] Foreign Application Priority Data

Jun. 6, 1986 [FR] France ..... 86 08223

[51] Int. Cl.[5] ..... A47K 3/22

[52] U.S. Cl. ..... 4/605; 4/615; 4/567; 138/118; 138/177; 138/178

[58] Field of Search ..... 4/191, 192, 567, 568, 4/615, 605; 239/273, 282, 283; 138/118, 120

[56] References Cited

U.S. PATENT DOCUMENTS

| | | | |
|---|---|---|---|
| 1,985,502 | 12/1934 | Isenberg | 239/282 |
| 3,021,871 | 2/1962 | Rodgers | 138/118 |
| 3,737,107 | 6/1973 | Wright | 239/282 X |
| 4,009,734 | 3/1977 | Sullivan | 138/118 |
| 4,137,948 | 2/1979 | Van Heijst | 138/120 |

FOREIGN PATENT DOCUMENTS

| | | | |
|---|---|---|---|
| 1101795 | 10/1955 | France | 4/570 |
| 2542601 | 9/1984 | France | 4/615 |
| 340460 | 9/1959 | Switzerland | 4/615 |
| 8607124 | 12/1986 | World Int. Prop. O. | 138/118 |

*Primary Examiner*—Charles E. Phillips

*Attorney, Agent, or Firm*—Sughrue, Mion, Zinn, MacPeak & Seas

[57] ABSTRACT

A movable shower assembly having an automatically retracting hose and a shower head capable of taking up multiple positions The invention relates to a assembly providing:

(1) at rest, an automatically retracting hose which is compact and which therefore does not hang over associated sanitary ware;

(2) in use, a greater length of hose than is possible with conventional designs; and (3) a shower head which can be put into any convenient position both when at rest and when in use, thus optimizing shower comfort, this being achieved by a suction cup fixing system (4).

The shower assembly is constituted by a support (1), a hose (2), and a shower head (3), said hose is of round or shaped cross section and is wound helically to constitute a helical spring shape, and said shower head and said support together constitute a housing for enclosing said hose when retracted.

6 Claims, 1 Drawing Sheet

MOVABLE SHOWER ASSEMBLY HAVING AN AUTOMATICALLY RETRACTING HOSE AND A SHOWER HEAD CAPABLE OF TAKING UP MULTIPLE POSITIONS

This is a division of application Ser. No. 054,563 filed May 27, 1987, now abandoned.

The present invention relates essentially to sanitary ware. It relates more particularly to a movable shower assembly having an automatically retracting hose and a shower head capable of taking up multiple positions.

BACKGROUND OF THE INVENTION

Shower assemblies are conventionally constituted by:

(a) a hose which may be in the form of a flexible tube protected by metal coils or in the form of a plastic hose optionally including braiding. In either case the hose is generally linear in shape and has a length lying in the range 1.25 meters (m) to 2 m. When not in use, the hose hangs down into a bath tub or other bathroom fitting where it is dirtied by contact with dirty water. Sometimes the hose can be hidden away into a chute (requiring a hole to be made), in which case it dirties a volume that is inaccessible for cleaning. The hole often leads to water seeping under the bath tub. Further, these drawbacks (difficulty of storage and problems with dirt) make it undesirable to install a longer hose, even though a longer hose would often be convenient when the shower head is in use. As a result of shower hoses not being really long enough, they are often damaged by the user pulling on them;

(b) a shower head fixed to one end of the hose; and (c) shower head supports fixed to the wall or to the faucets, said supports being fixed or including a shower head swivel, and/or being adjustable in height along a slide. —

In most cases such assemblies require holes to be drilled in a wall. They are expensive to buy and to install. Further, since such assemblies are unsuitable for fixing in numerous different places to facilitate showering, the user has to hold the shower head in the hand or else make do with the shower head being fixed to a single support.

The present invention seeks to mitigate the above drawbacks.

The assembly is constituted by the various separate items assembled together.

SUMMARY OF THE INVENTION

The present invention provides a shower assembly comprising a support, a hose, and a shower head, wherein said hose is of round or shaped cross section and is wound helically to constitute a helical spring shape, and wherein said shower head and said support together constitute a housing for enclosing said hose when retracted.

BRIEF DESCRIPTION OF THE DRAWING

Embodiments of the invention are described by way of example with reference to the accompanying drawing, in which.

MORE DETAILED DESCRIPTION

Figure 1:
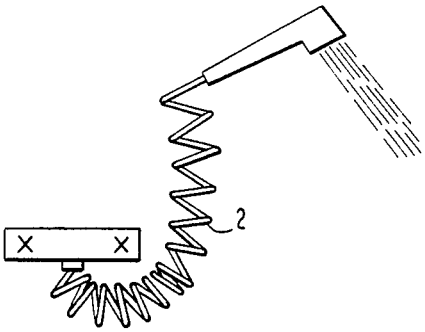
FIGS. 1 and 2 show the use of a particular embodiment of support or hose.
Figure 2:
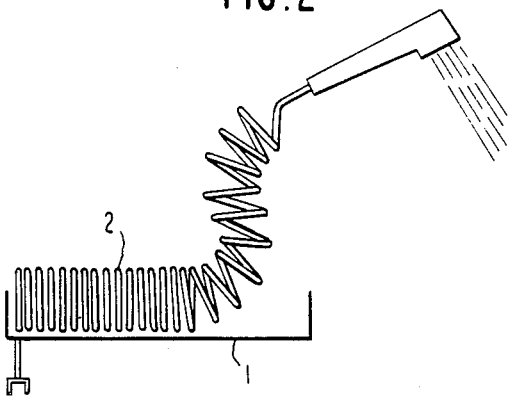

The assembly comprises a support 1 having a semicylindrical housing into which or onto which the turns of a hose 2 manufactured in the form of a helical spring automatically coil up in a horizontal or vertical position solely by the spring effect, with the shower head 3 being placed on the support and the coiled up hose and totally or partially hiding the hose. To this end, the shower head preferably has a hand grip portion with at least one concave surface in the hand grip portion thereof in the form of a sector of a cylinder, as shown by the broken line in FIG. 3.

The shower head may take up multiple positions in use by virtue of a suction cup 4. Thus, the shower head can be placed in any desired position. Independently from the shower head, the support could also have such a suction cup 8. In a preferred implementation, the suction cup includes means for putting its center under tension so as to increase the suction beneath the cup, or else a piston type system for increasing the suction and identified schematically as element 9 and 9' in FIG. 3. Such systems are well known.

Figure 3:
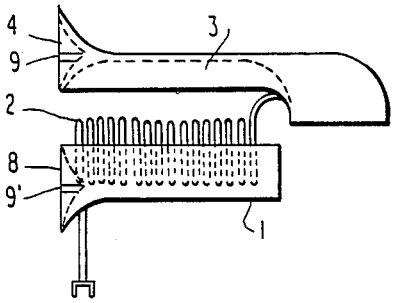
FIG. 3 shows a different embodiment of the invention.

In FIG. 3, the support 1 for receiving the automatically retracting hose includes a suction cup 8 for fixing the support to the wall close to the faucets.

Figure 4:
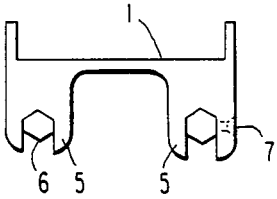
FIG. 4 shows a support mounted on faucet-retaining nuts.

In another embodiment shown in FIG. 4, the support is fixed directly to the faucets by having a shaped plate 5 suitable for engaging either one or two faucet-retaining nuts 6.

The support is clamped in position either by means of a screw 7 or else by means of the shaped plate 5 snap-fastening to the, or each, nut 6.

The hose is made of plastic material, is of round cross-section (or of shaped cross-section in order to obtain a pleasing appearance), and the turns of the hose may be of different shapes.

Figure 5:
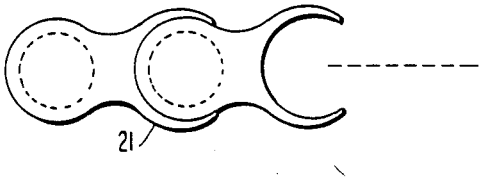
FIG. 5 is a section view through two contiguous turns of one example of the hose.

In a preferred embodiment, the section of the hose 21 includes a male-female turn-engagement system enabling the turns to be fixed together merely by applying pressure thereto (see FIG. 5), thus enabling the hose to constitute all or part of the support. The hose may naturally be provided in various different colors, or be made of metal.

Naturally the present invention is not limited to the above-described embodiments, but extends to any embodiment falling within the scope of the claims.

I claim:

1. A shower assembly, comprising: a support (1) having a semi-cylindrical housing, a hose (2), and a hand manipulable shower head (3) having at least one concave surface in the form of a sector of a cylinder, wherein said hose is of round or shaped cross section and is wound helically to constitute a helical spring shape, wherein said shower head and said support together constitute a housing for at least partially enclosing said hose when retracted and wherein the shower head comprises an elongate hand grip portion followed by a water outlet nozzle, an outlet end of the hose being coupled to the shower head proximate an interface region between the hand grip portion and the nozzle, and the length of the support being approximate that of the hand grip portion.

2. A shower assembly according to claim 1, wherein the support is fixed by a shaped member suitable for engaging at least one faucet-retaining nut.

3. A shower assembly according to claim 1, wherein the support includes a suction cup.

4. A shower assembly according to claim 1, wherein the shower head is provided with a suction cup.

5. A shower assembly according to claim 3 or 4, wherein the suction cup co-operates with pressure-reducing means enabling the suction beneath the cup to be increased.

6. A shower assembly according to claim 1, wherein the hose has a cross-section suitable for constituting a male-female engagement system for adjacent turns thereof, thus enabling the turns to be fixed together and to constitute a part of the support.

* * * * *